US008674976B2

(12) United States Patent
Kim et al.

(10) Patent No.: US 8,674,976 B2
(45) Date of Patent: Mar. 18, 2014

(54) LIQUID CRYSTAL DISPLAY CAPABLE OF REDUCING POWER CONSUMPTION AND METHOD FOR DRIVING THE SAME

(75) Inventors: Jongwoo Kim, Kyungbuk (KR); Yongchae Jung, Daegu (KR); Sunguk Byun, Daegu (KR); Jinkoo Kim, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 338 days.

(21) Appl. No.: 13/158,520

(22) Filed: Jun. 13, 2011

(65) Prior Publication Data

US 2012/0013591 A1 Jan. 19, 2012

(30) Foreign Application Priority Data

Jul. 19, 2010 (KR) ..... 10-2010-0069463

(51) Int. Cl.
*G09G 5/00* (2006.01)

(52) U.S. Cl.
USPC ..... 345/211; 345/96; 345/99; 345/690

(58) Field of Classification Search
USPC ..... 345/89–100, 690
See application file for complete search history.

(56) References Cited

U.S. PATENT DOCUMENTS

2004/0263466 A1* 12/2004 Song et al. ..... 345/100
2005/0151712 A1* 7/2005 Pai ..... 345/98
2007/0030225 A1* 2/2007 Moon et al. ..... 345/89
2007/0115302 A1* 5/2007 Huang ..... 345/690
2008/0278427 A1* 11/2008 Jang et al. ..... 345/98
2009/0002302 A1* 1/2009 Koo et al. ..... 345/89
2011/0012822 A1* 1/2011 Park et al. ..... 345/99

FOREIGN PATENT DOCUMENTS

KR 10-2007-0016356 A 2/2007
KR 10-2009-0095912 A 9/2009

OTHER PUBLICATIONS

Korean Office Action dated May 16, 2013 for corresponding application No. KR 10-2010-0069463.

* cited by examiner

*Primary Examiner* — Srilakshmi K Kumar
*Assistant Examiner* — James Nokham
(74) *Attorney, Agent, or Firm* — Morgan, Lewis & Bockius LLP

(57) ABSTRACT

A liquid crystal display includes a liquid crystal display panel including data lines, gate lines crossing the data lines, and liquid crystal cells arranged at crossings of the data lines and the gate lines in a matrix form, a data driving circuit supplying a data voltage to the data lines, and a power consumption reduction circuit, that calculates the number of black pixels, white pixels, or both included in an input image, decides whether or not the input image is a problem pattern increasing power consumption of the data driving circuit based on the calculation result, selectively activates a charge sharing function, which shorts between adjacent output channels of the data driving circuit during a predetermined period, and differently controls a polarity inversion period of the data voltage based on the decision result.

7 Claims, 10 Drawing Sheets

(A) Full Black (B) Full White (C) L80

| Control signal \ Data pattern | Normal pattern | Problem pattern |
|---|---|---|
| POL | V2 dot Inv. | Frame Inv. |
| CSC | H(on) | L(off) |

FIG. 7A

CSC : L ($00_2$)

| CS1 | CS2 | CS3 | POL |
|---|---|---|---|
| $0_2$ | $00_2$ | $00_2$ | + |
| | $01_2$ | $00_2$ | + |
| | $10_2$ | $00_2$ | + |
| | $11_2$ | $00_2$ | + |
| $1_2$ | $00_2$ | $00_2$ | − |
| | $01_2$ | $00_2$ | − |
| | $10_2$ | $00_2$ | − |
| | $11_2$ | $00_2$ | − |

FIG. 7B

CSC : H ($11_2$)

| CS1 | CS2 | CS3 | POL |
|---|---|---|---|
| $0_2$ | $00_2$ | $00_2$ | + |
| | $01_2$ | $01_2$ | − |
| | $10_2$ | $10_2$ | − |
| | $11_2$ | $11_2$ | + |
| $1_2$ | $00_2$ | $00_2$ | − |
| | $01_2$ | $01_2$ | + |
| | $10_2$ | $10_2$ | + |
| | $11_2$ | $11_2$ | − |

LIQUID CRYSTAL DISPLAY CAPABLE OF REDUCING POWER CONSUMPTION AND METHOD FOR DRIVING THE SAME

This application claims the benefit of Korean Patent Application No. 10-2010-0069463 filed on Jul. 19, 2010, which is incorporated herein by reference for all purposes as if fully set forth herein.

BACKGROUND OF THE INVENTION

1. Field of the Invention

Embodiments of the invention relate to a liquid crystal display and a method for driving the same capable of reducing power consumption of a data driving circuit.

2. Discussion of the Related Art

Liquid crystal displays display an image by adjusting light transmittances of liquid crystal cells in response to a video signal. An active matrix type liquid crystal display switches on or off a data voltage supplied to liquid crystal cells using a thin film transistor (TFT) formed in each of the liquid crystal cells to thereby actively control data. Therefore, display quality of the active matrix type liquid crystal display may increase.

The liquid crystal display inverts a charging polarity of the data voltage every predetermined liquid crystal cells, so as to reduce a direct current (DC) offset component and to reduce degradation of liquid crystals. However, every time the charging polarity of the data voltage is inverted in an inversion driving scheme, a swing width of the data voltage supplied to data lines increases, and a heat generation temperature of a data driving circuit increases. As a result, power consumption of the data driving circuit greatly increases.

A charge sharing method illustrated in FIGS. 1A and 1B has been proposed, so as to reduce the swing width of the data voltage, to reduce the heat generation temperature of the data driving circuit, and to achieve low power consumption. The charge sharing method turns on a charge sharing switch SW1 connected between adjacent output channels of the data driving circuit during a high logic level period of a source output enable SOE and shares positive charges and negative charges with one another inside a liquid crystal display panel, thereby changing an initial output level of the data driving circuit to a middle level.

The application of the charge sharing method does not always reduce the power consumption of the data driving circuit. The charge sharing method generally reduces the power consumption of the data driving circuit when a data pattern, of which data successively output through the same channel has a large gray level difference, is displayed. On the other hand, the charge sharing method increases the power consumption of the data driving circuit when a data pattern, of which data has a small gray level difference, is displayed.

In the related art, as shown in FIG. 2, a charge sharing function was unconditionally activated irrespective of characteristics of a data pattern input to the data driving circuit, and a polarity inversion period of the data voltage successively output through the same channel was fixed to k horizontal period, where k is a positive integer. FIG. 2 illustrates an output swing width of the data driving circuit when the liquid crystal display implements a full black pattern by activating the charge sharing function in the liquid crystal display panel, which operates in a normally white mode (representing a low gray level as a voltage level difference between the data voltage and a common voltage increases), and applying the data voltage to the data driving circuit in a vertical 2-dot inversion scheme (inverting the polarity of the data voltage every two horizontal periods). In the normally white mode, the output swing width of the data driving circuit has a maximum value when the full black pattern is implemented. In FIG. 2, 'Vdd' and 'Vss' denote power voltages for determining an output range of the data driving circuit, and 'Vcom' denotes the common voltage of the liquid crystal display panel.

In the related art, the data voltage swings between the power voltages Vdd (i.e., a positive maximum power voltage) and Vss (i.e., a negative maximum power voltage) every two horizontal periods, so as to implement the vertical 2-dot inversion scheme under the above-described conditions. Further, the data voltage has to swing between the positive maximum power voltage Vdd and the common voltage Vcom or between the negative maximum power voltage Vss and the common voltage Vcom in units of one horizontal period, so as to implement the charge sharing method under the above-described conditions. Thus, because the number of swing operations of the data voltage increases, it is difficult to reduce the power consumption of the data driving circuit.

SUMMARY OF THE INVENTION

Embodiments of the invention provide a liquid crystal display and a method for driving the same capable of reducing power consumption of a data driving circuit irrespective of an input data pattern.

In one aspect, there is a liquid crystal display including a liquid crystal display panel including a plurality of data lines, a plurality of gate lines crossing the plurality of data lines, and a plurality of liquid crystal cells arranged at crossings of the data lines and the gate lines in a matrix form, a data driving circuit configured to supply a data voltage to the data lines, and a power consumption reduction circuit configured to calculate the number of black pixels, white pixels, or both included in an input image, decide whether or not the input image is a problem pattern increasing power consumption of the data driving circuit based on the calculation result, selectively activate a charge sharing function, which shorts between adjacent output channels of the data driving circuit during a predetermined period, and differently control a polarity inversion period of the data voltage based on the decision result.

When the input image is the problem pattern, the power consumption reduction circuit increases a logic level inversion period of a polarity control signal from k horizontal period (where k is a positive integer), that has been previously set to a default value, to one frame period, and at the same time, inverts a charge share control signal from a high logic level, that has been previously set to a default value, to a low logic level, thereby inactivating the charge sharing function. When the input image is a normal pattern other than the problem pattern, the power consumption reduction circuit holds the logic level inversion period of the polarity control signal in the k horizontal period, and at the same time, holds the logic level of the charge share control signal at the high logic level, thereby activating the charge sharing function.

The power consumption reduction circuit includes a frame counter configured to count the number of vertical sync signals and generate a first count signal, a line counter configured to count the number of horizontal sync signals and generate a second count signal, a problem pattern deciding unit configured to calculate the number of black pixels, white pixels, or both included in the input image, decide whether or not the input image is the problem pattern based on the calculation result, generate the charge share control signal of the low logic level when the input image is the problem pattern, and generate the charge share control signal of the high logic level when the input image is the normal pattern, an AND gate configured to perform AND operation on the second count signal received from the line counter and the charge share control signal received from the problem pattern deciding unit and generate a third count signal, and a polarity controller configured to control the logic level inversion period of the polarity control signal based on the first count signal received from the frame counter and the third count signal received from the AND gate.

The data driving circuit includes a plurality of first switches, each of which is connected between the two adjacent output channels so as to perform the charge sharing function, a plurality of second switches, each of which is connected between an output buffer and the output channel, a third switch configured to selectively apply a source output enable to the first switches in response to the charge share control signal, and a plurality of inverters configured to invert the source output enable and apply the inverted source output enable to the second switches.

The liquid crystal display panel represents a gray level by a voltage level difference between the data voltage and a common voltage. When the liquid crystal display panel operates in a normally white mode, in which a low gray level is represented as the voltage level difference increases, the problem pattern includes a full black pattern.

Further, when the liquid crystal display panel operates in a normally black mode, in which a high gray level is represented as the voltage level difference increases, the problem pattern includes at least one of a full white pattern and an L80 pattern. The L80 pattern indicates a data pattern in which a percentage of a white area based on an effective display area is about 64% and a percentage of a black area based on the effective display area is about 36%.

In another aspect, there is a method for driving a liquid crystal display including a liquid crystal display panel including a plurality of data lines, a plurality of gate lines crossing the plurality of data lines, and a plurality of liquid crystal cells arranged at crossings of the data lines and the gate lines in a matrix form and a data driving circuit supplying a data voltage to the data lines, the method including calculating the number of black pixels, white pixels, or both included in an input image, deciding whether or not the input image is a problem pattern increasing power consumption of the data driving circuit based on the calculation result, and (C) selectively activating a charge sharing function, which shorts between adjacent output channels of the data driving circuit during a predetermined period, and differently controlling a polarity inversion period of the data voltage based on the decision result.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings:

FIG. 7A illustrates first to third count signals and a polarity control signal generated when a problem pattern is input;

FIG. 7B illustrates first to third count signals and a polarity control signal generated when a normal pattern is input;

DETAILED DESCRIPTION OF THE ILLUSTRATED EMBODIMENTS

Reference will now be made in detail embodiments of the invention examples of which are illustrated in the accompanying drawings.

Figure 3:
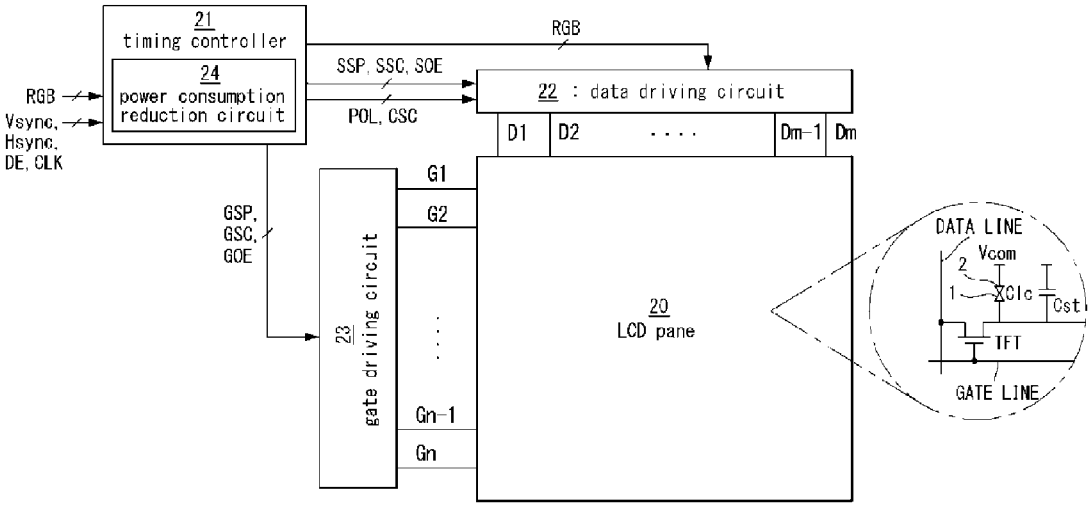
FIG. 3 illustrates a liquid crystal display according to an example embodiment of the invention.

FIG. 3 illustrates a liquid crystal display according to an example embodiment of the invention.

As shown in FIG. 3, a liquid crystal display according to an example embodiment of the invention includes a liquid crystal display panel 20, a timing controller 21, a data driving circuit 22, a gate driving circuit 23, and a power consumption reduction circuit 24.

The liquid crystal display panel 20 includes liquid crystal molecules disposed between an upper glass substrate and a lower glass substrate. The liquid crystal display panel 20 includes m×n liquid crystal cells Clc, that are arranged in a matrix form based on a crossing structure between data lines D1 to Dm and gate lines G1 to Gn, where m and n are a positive integer.

A pixel array is formed on the lower glass substrate of the liquid crystal display panel 20. The pixel array includes the m data lines D1 to Dm, the n gate lines G1 to Gn, thin film transistors (TFTs), pixel electrodes 1 of the liquid crystal cells Clc connected to the TFTs, and storage capacitors Cst.

Black matrixes, color filters, and common electrodes 2 are formed on the upper glass substrate of the liquid crystal display panel 20. The common electrode 2 is formed on the upper glass substrate in a vertical electric field driving manner such as a twisted nematic (TN) mode and a vertical alignment (VA) mode. The common electrode 2 is formed on the lower glass substrate along with the pixel electrode 1 in a horizontal electric field driving manner such as an in-plane switching (IPS) mode and a fringe field switching (FFS) mode.

Polarizing plates having optical axes, that are perpendicular to each other, are respectively attached to the upper and lower glass substrates of the liquid crystal display panel 20. Alignment layers for setting pre-tilt angles of the liquid crystals are respectively formed inside the upper and lower glass substrates of the liquid crystal display panel 20 contacting the liquid crystals.

Figure 8:
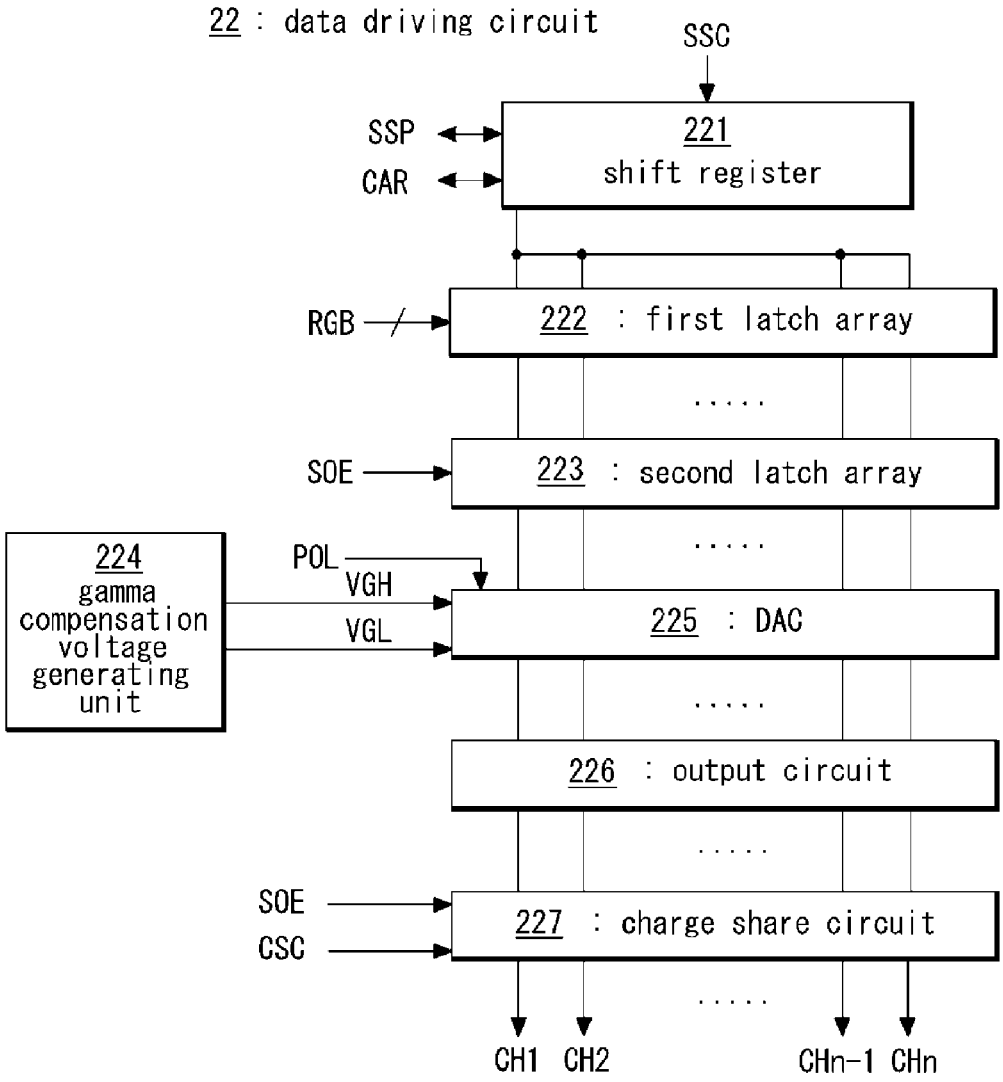
FIGS. 8 and 9 illustrate in detail a data driver integrated circuit.
Figure 9:
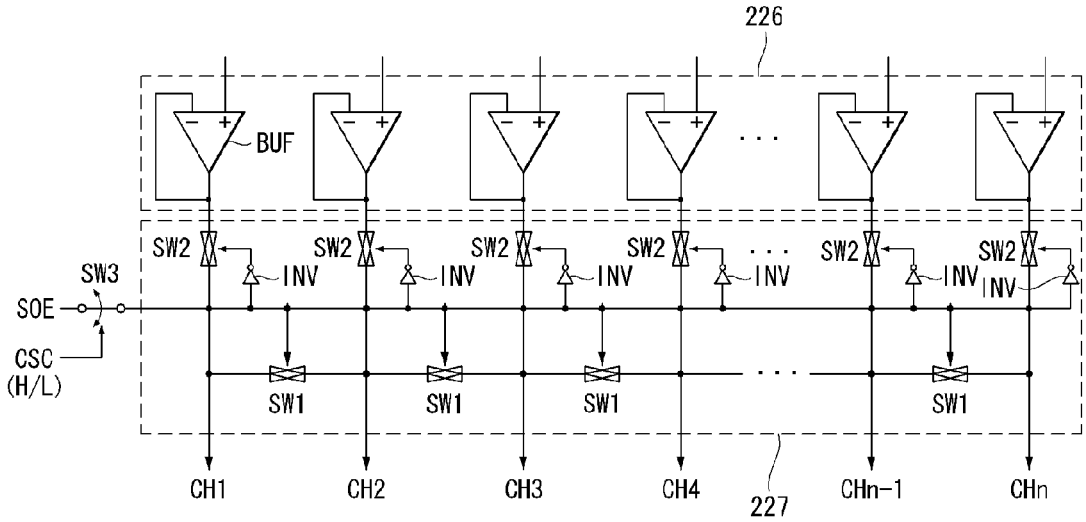

The data driving circuit 22 includes a plurality of data driver integrated circuits (ICs) shown in FIGS. 8 and 9. The data driving circuit 22 latches digital video data RGB under the control of the timing controller 21 and converts the latched digital video data RGB into positive and negative analog gamma compensation voltages, thereby generating positive and negative data voltages. The data driving circuit 22 then supplies the positive and negative data voltages to the data lines D1 to Dm. The data driver ICs may be mounted on a tape carrier package (TCP) and may be bonded to the lower glass substrate of the liquid crystal display panel 20 through a tape automated bonding (TAB) process.

The gate driving circuit 23 includes a shift register, a level shifter for converting an output signal of the shift register into a swing width suitable for a TFT drive of the liquid crystal cells, an output buffer connected between the level shifter and the gate lines G1 to Gn, and the like. The gate driving circuit 23 sequentially supplies a scan pulse having a width of about one horizontal period to the gate lines G1 to Gn under the control of the timing controller 21. The gate driving circuit 23 may be mounted on the TCP and may be bonded to the lower glass substrate of the liquid crystal display panel 20 through the TAB process. Alternatively, the gate driving circuit 23 and the pixel array may be simultaneously and directly formed on the lower glass substrate of the liquid crystal display panel 20 through a gate-in-panel (GIP) process.

The timing controller 21 rearranges the digital video data RGB received from a system board (not shown) in conformity with the liquid crystal display panel 20 and supplies the rearranged digital video data RGB to the data driving circuit 22. The timing controller 21 receives timing signals, such as a vertical sync signal Vsync, a horizontal sync signal Hsync, a data enable DE, and a clock CLK, from the system board. The timing controller 21 generates control signals for controlling operation timings of the data driving circuit 22 and the gate driving circuit 23 using the timing signals.

A data timing control signal for controlling the operation timing of the data driving circuit 22 includes a source start pulse SSP, a source sampling clock SSC, a polarity control signal POL, a source output enable SOE, and the like. The source start pulse SSP controls a data sampling start time of the data driving circuit 22. The source sampling clock SSC controls a sampling time of data inside the data driving circuit 22 based on a rising or falling edge thereof. The source output enable SOE controls an output time of the data driving circuit 22. The polarity control signal POL controls a horizontal polarity inversion timing of the data voltage output from the data driving circuit 22. A logic level inversion period of the polarity control signal POL is fixed to k horizontal period, where k is a positive integer. For example, when the data driving circuit 22 is controlled in a vertical 2-dot inversion scheme, a logic level of the polarity control signal POL may be inverted every two horizontal periods. Further, when the data driving circuit 22 is controlled in a vertical 1-dot inversion scheme, a logic level of the polarity control signal POL may be inverted every one horizontal period. In other words, a polarity inversion period of the data voltage successively output through the same channel of the data driving circuit 22 depends on the logic level inversion period of the polarity control signal POL.

A gate timing control signal for controlling the operation timing of the gate driving circuit 23 includes a gate start pulse GSP, a gate shift clock GSC, a gate output enable GOE, and the like. The gate start pulse GSP is generated once, at a time when one frame period starts, during the one frame period and generates a first gate pulse. The gate shift clock GSC is commonly input to a plurality of stages constituting the shift register and shifts the gate start pulse GSP. The gate output enable GOE controls an output of the gate driving circuit 23.

Figure 4:
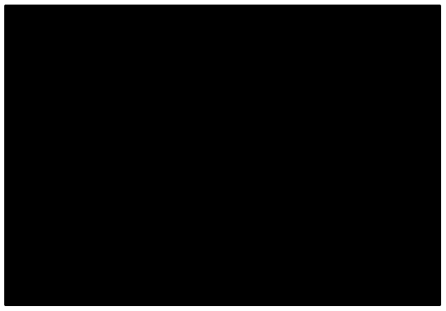
FIG. 4 illustrates an example of a problem pattern.
Figure 4:
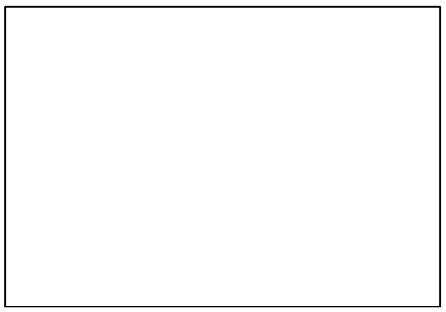
Figure 4:
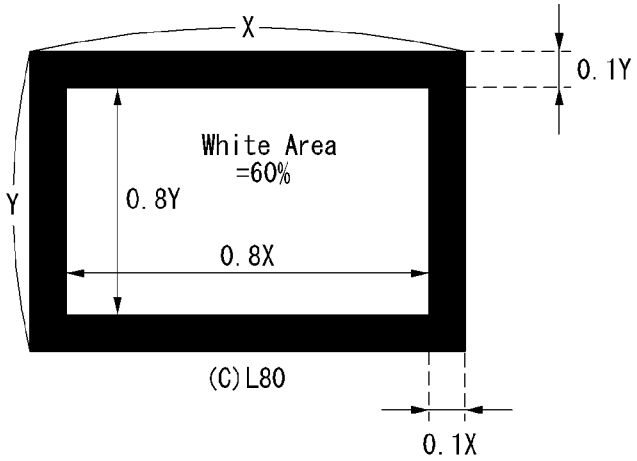
Figures 5, 6:
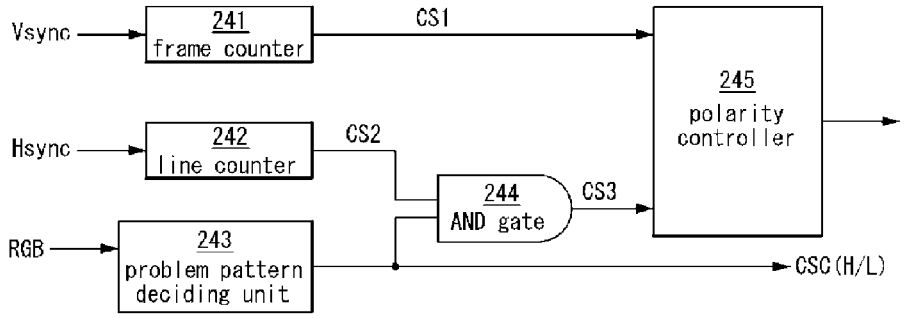
FIG. 5 illustrates an operation of a power consumption reduction circuit based on an input data pattern.
FIG. 6 illustrates in detail a power consumption reduction circuit.

The power consumption reduction circuit 24 selectively activates a charge sharing function based on an input data pattern and varies the polarity inversion period of the data voltage. For example, when the input data pattern is a problem pattern shown in FIG. 4, as shown in FIG. 5, the power consumption reduction circuit 24 increases the logic level inversion period of the polarity control signal POL from k horizontal period (where k is 2), that has been previously set to a default value, to one frame period, and at the same time, inverts a charge share control signal CSC from a high logic level H, that has been previously set to a default value, to a low logic level L, thereby inactivating (off) the charge sharing function. On the other hand, when the input data pattern is a normal pattern other than the problem pattern, as shown in FIG. 5, the power consumption reduction circuit 24 holds the logic level inversion period of the polarity control signal POL in the k horizontal period, and at the same time, holds the logic level of the charge share control signal CSC at the high logic level H, thereby activating (on) the charge sharing function.

The problem pattern indicates a data pattern increasing power consumption of the data driving circuit 22. For example, as shown in FIG. 4, the problem pattern may include (A) a full black pattern, (B) a full white pattern, and (C) a L80 pattern. When the liquid crystal display panel 20 operates in a normally white mode (representing a low gray level as a voltage level difference between the data voltage and a common voltage increases) such as the TN mode and the VA mode, the power consumption of the data driving circuit 22 greatly increases in the full black pattern. On the other hand, when the liquid crystal display panel 20 operates in a normally black mode (representing a high gray level as the voltage level difference between the data voltage and the common voltage increases) such as the IPS mode and the FFS mode, the power consumption of the data driving circuit 22 greatly increases in the full white pattern and the L80 pattern. In the embodiment of the invention, the L80 pattern indicates a data pattern in which a percentage of a white area based on an effective display area (X*Y) is about 64% and a percentage of a black area based on the effective display area (X*Y) is about 36%.

The normally white mode and the normally black mode are liquid crystal driving modes. The liquid crystal display panel 20 selects one of the normally white mode and the normally black mode and is fixed to the selected mode in a process for forming the liquid crystal display panel 20. The power consumption reduction circuit 24 previously and differently sets the problem patterns depending on the liquid crystal driving mode.

FIG. 6 illustrates in detail the power consumption reduction circuit 24 shown in FIG. 3. FIG. 7A illustrates first to third count signals and a polarity control signal generated when a problem pattern is input. FIG. 7B illustrates first to third count signals and a polarity control signal generated when a normal pattern is input As shown in FIG. 6, the power consumption reduction circuit 24 includes a frame counter 241, a line counter 242, a problem pattern deciding unit 243, an AND gate 244, and a polarity controller 245. The power consumption reduction circuit 24 may be mounted in the timing controller 21.

The frame counter 241 counts the vertical sync signals Vsync and generates a first count signal CS1 using a count value of the vertical sync signals Vsync. The first count signal CS1 is implemented as 1-bit binary signal. Every time the count value of the vertical sync signals Vsync increases by "1", the first count signal CS1 is sequentially generated as binary values of '02' and '12' as shown in FIGS. 7A and 7B.

The line counter 242 counts the horizontal sync signals Hsync and generates a second count signal CS2 using a count value of the horizontal sync signals Hsync. The second count signal CS2 is implemented as 2-bit binary signal. Every time the count value of the horizontal sync signals Hsync increases by "1", the second count signal CS2 is sequentially generated as binary values of '002', '012', '102', and '112' as shown in FIGS. 7A and 7B.

The problem pattern deciding unit 243 calculates the number of black pixels, white pixels, or both included in an input image RGB and decides whether or not the input image RGB is the problem pattern based on the calculation result. More specifically, when the problem pattern appears as the full black pattern shown in FIG. 4(A), the problem pattern deciding unit 243 counts the number of black pixels included in the input image RGB. When a count value of the black pixels is greater than a first reference value, that is previously set, the problem pattern deciding unit 243 decides the input image RGB as the problem pattern. When the count value of the black pixels is equal to or less than the first reference value, the problem pattern deciding unit 243 decides the input image RGB as the normal pattern. Further, when the problem pattern appears as the full white pattern shown in FIG. 4(B), the problem pattern deciding unit 243 counts the number of white pixels included in the input image RGB. When a count value of the white pixels is greater than a second reference value, that is previously set, the problem pattern deciding unit 243 decides the input image RGB as the problem pattern. When the count value of the white pixels is equal to or less than the second reference value, the problem pattern deciding unit 243 decides the input image RGB as the normal pattern. Further, when the problem pattern appears as the L80 pattern shown in FIG. 4(C), the problem pattern deciding unit 243 counts the number of white pixels and the number of black pixels. When a count value of the white pixels is within a first reference range, that is previously set, and at the same time a count value of the black pixels is within a second reference range, that is previously set, the problem pattern deciding unit 243 decides the input image RGB as the problem pattern. When the count value of the white pixels is greater than the first reference range, and at the same time the count value of the black pixels is greater than the second reference range, the problem pattern deciding unit 243 decides the input image RGB as the normal pattern.

When the input image RGB is the problem pattern, the problem pattern deciding unit 243 generates the charge share control signal CSC of a low logic level 'L'. On the other hand, when the input image RGB is the normal pattern, the problem pattern deciding unit 243 generates the charge share control signal CSC of a high logic level 'H'. The charge share control signal CSC is implemented as 2-bit binary signal. As shown in FIG. 7A, when the input image RGB is the problem pattern, the charge share control signal CSC is generated as the binary value of '$00_2$'. As shown in FIG. 7B, when the input image RGB is the normal pattern, the charge share control signal CSC is generated as the binary value of '$11_2$'.

The AND gate 244 performs AND operation on the second count signal CS2 received from the line counter 242 and the charge share control signal CSC received from the problem pattern deciding unit 243 to generate a third count signal CS3. The third count signal CS3 is implemented as 2-bit binary signal. As shown in FIG. 7A, when the input image RGB is the problem pattern, the third count signal CS3 is always generated as the binary value of '$00_2$'. As shown in FIG. 7B, when the input image RGB is the normal pattern, the third count signal CS3 is generated as the same binary value as the second count signal CS2.

The polarity controller 245 controls a logic level inversion period of the polarity control signal POL based on the first count signal CS1 received from the frame counter 241 and the third count signal CS3 received from the AND gate 244.

As shown in FIG. 7B, when the input image RGB is the normal pattern, the polarity controller 245 controls the logic level inversion period of the polarity control signal POL to be k horizontal period specified to a default value in reference to the first count signal CS1 generated as the binary values of '$0_2$' and '$1_2$' based on frame accumulation and the third count signal CS3 generated as the binary values of '$00_2$', '$01_2$', '$10_2$', and '$11_2$' based on line accumulation, where k is 2. For this, the polarity control signal POL is previously set, so that the polarity control signal POL having the polarity of '+' is generated when the first count signal CS1 is '$0_2$' and the third count signal CS3 is '$00_2$' or '$11_2$'; the polarity control signal POL having the polarity of '−' is generated when the first count signal CS1 is '$0_2$' and the third count signal CS3 is '$01_2$' or '$10_2$'; the polarity control signal POL having the polarity of '−' is generated when the first count signal CS1 is '$1_2$' and the third count signal CS3 is '$00_2$' or '$11_2$'; and the polarity control signal POL having the polarity of '+' is generated when the first count signal CS1 is '$1_2$' and the third count signal CS3 is '$01_2$' or '$10_2$'.

Figure 1A:
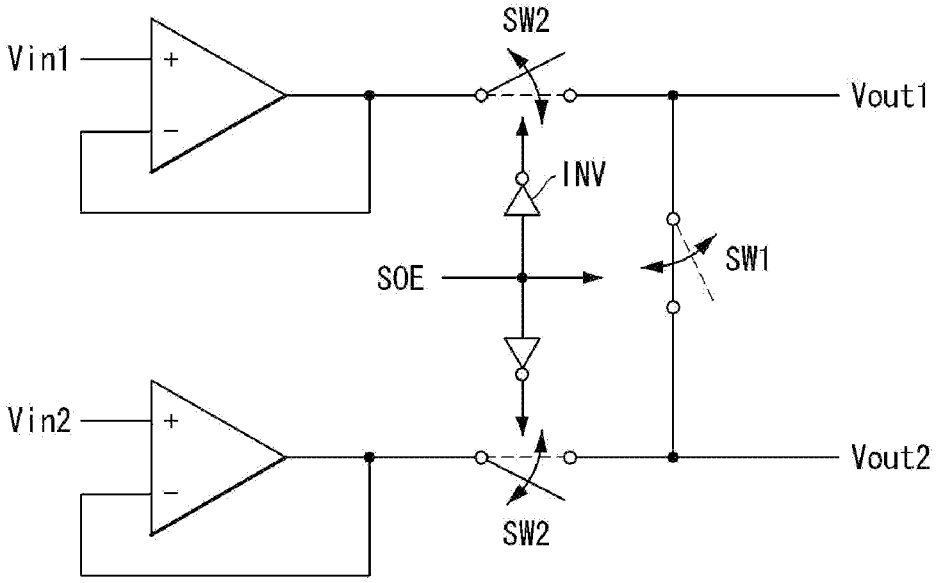
FIG. 1A (RELATED ART)
FIGS. 1A and 1B illustrate a related art charge sharing method.
Figure 1B:
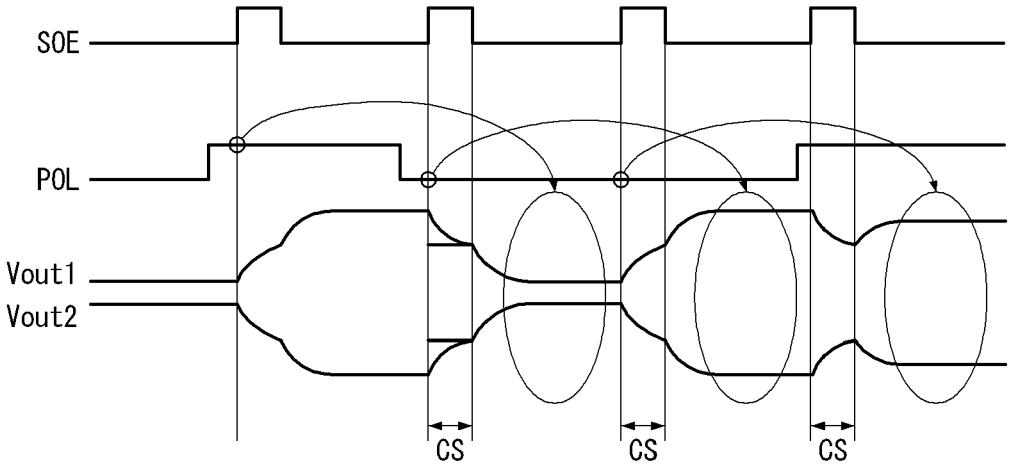
FIG. 1B (RELATED ART)
Figure 2:
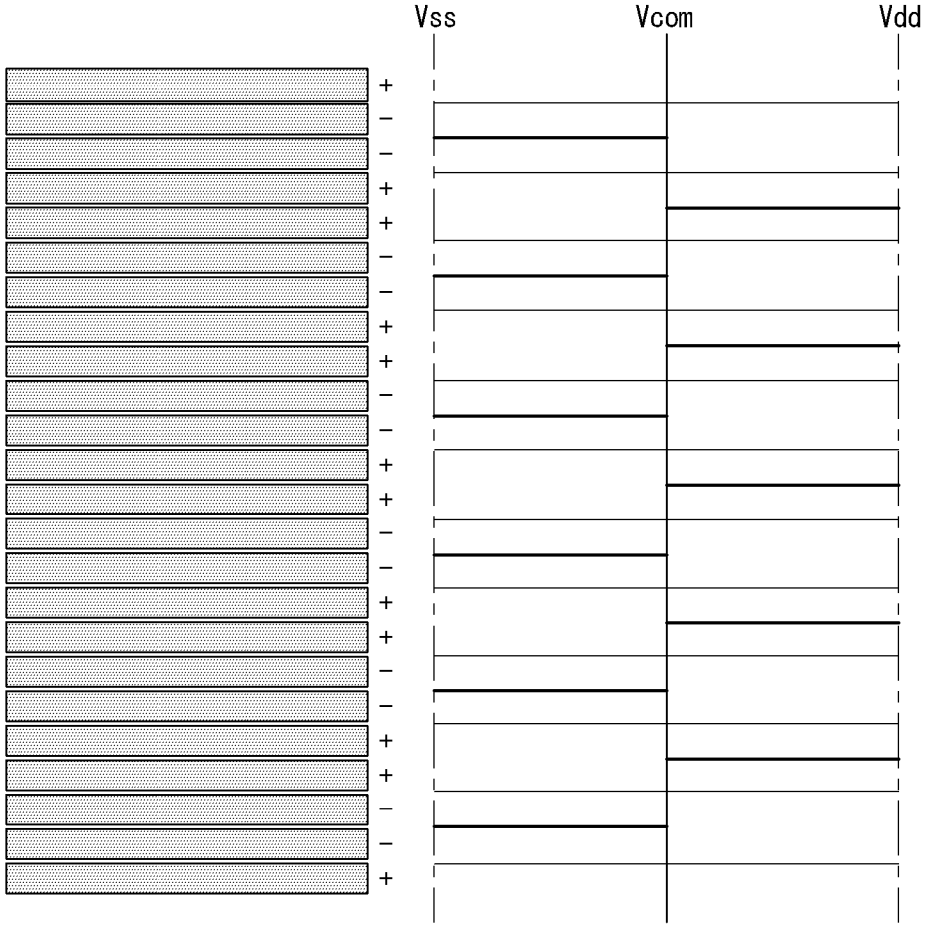
FIG. 2 (RELATED ART)
FIG. 2 illustrates an output swing width of a data driving circuit when a full black pattern is implemented in the related art.

As shown in FIG. 7A, when the input image RGB is the problem pattern, polarity controller 245 increases the logic level inversion period of the polarity control signal POL from the k horizontal period specified to the default value to one frame period in reference to the first count signal CS1 sequentially generated as the binary values of '$0_2$' and '$1_2$' based on the frame accumulation and the third count signal CS3 generated as only the binary value of '$00_2$' irrespective of the line accumulation, where k is 2. The polarity control signal POL having the polarity of '+' is generated when the first count signal CS1 is '$0_2$' and the third count signal CS3 is '$00_2$', and the polarity control signal POL having the polarity of '−' is generated when the first count signal CS1 is '$1_2$' and the third count signal CS3 is '002'. When the problem pattern is input, a charge sharing operation of the data driving circuit 22 stops, and the data voltage swings between the positive maximum power voltage Vdd (refer to FIG. 2) and the negative maximum power voltage Vss (refer to FIG. 2) in units of one frame period. Therefore, the number of transition operations of the data voltage in the embodiment of the invention is greatly reduced as compared to the related art, in which the data voltage swings on the basis of line. As a result, the power consumption of the data driving circuit 22 is greatly reduced.

FIGS. 8 and 9 illustrate in detail one of the data driver ICs constituting the data driving circuit 22 shown in FIG. 3.

As shown in FIGS. 8 and 9, the data driver IC includes a shift register 221, a first latch array 222, a second latch array 223, a gamma compensation voltage generating unit 224, a digital-to-analog converter (DAC) 225, an output circuit 226, and a charge share circuit 227.

The shift register 221 shifts a sampling signal in response to the source sampling clock SSC. When data exceeding the number of latch operations of the first latch array 222 is supplied, the shift register 221 generates a carry signal CAR.

The first latch array 222 samples the digital video data RGB received from the timing controller 11 in response to the sampling signal sequentially received from the shift register 221, latches the sampled digital video data RGB corresponding to one horizontal line, and simultaneously outputs the latched digital video data RGB corresponding to the one horizontal line.

The second latch array 223 latches the digital video data RGB corresponding to the one horizontal line received from the first latch array 222. Then, the second latch array 223 and the second latch arrays 223 of the other data driver ICs simultaneously output the latched digital video data RGB during a low logic level period of the source output enable SOE.

The gamma compensation voltage generating unit 224 segments a plurality of gamma reference voltages into voltages as many as gray levels, that can be represented by the number of bits of the digital video data RGB. The gamma compensation voltage generating unit 224 generates positive gamma compensation voltages VGH and negative gamma compensation voltages VGL corresponding to the respective gray levels.

The DAC 225 includes a P-decoder receiving the positive gamma compensation voltage VGH, an N-decoder receiving the negative gamma compensation voltage VGL, and a multiplexer selecting an output of the P-decoder and an output of the N-decoder in response to the polarity control signal POL. The P-decoder decodes the digital video data RGB received from the second latch array 223 and outputs the positive gamma compensation voltage VGH corresponding to a gray level of the digital video data RGB. The N-decoder decodes the digital video data RGB received from the second latch array 223 and outputs the negative gamma compensation voltage VGL corresponding to a gray level of the digital video data RGB. The multiplexer selects the positive gamma compensation voltage VGH and the negative gamma compensation voltage VGL in response to the polarity control signal POL.

The output circuit 226 includes a plurality of buffers BUF, which are respectively connected to output channels shown in FIG. 9. The output circuit 226 minimizes signal attenuation of an analog data voltage supplied from the DAC 225.

The charge share circuit 227 includes a plurality of first switches SW1, each of which is connected between the two adjacent output channels, a plurality of second switches SW2, each of which is connected between an output terminal of the buffer BUF and the output channel, a third switch SW3, which is switched on or off in response to the charge share control signal CSC and selectively applies the source output enable SOE, and a plurality of inverters INV for inverting the source output enable SOE.

When the charge share control signal CSC of the high logic level is generated, the third switch SW3 is turned on and applies the source output enable SOE to the charge share circuit 227. During a high logic level period of the source output enable SOE, the first switches SW1 are turned on and short between the output channels, thereby activating the charge sharing operation. Further, the second switches SW2 are turned off and blocks an output of the data voltage. When the source output enable SOE is inverted from the high logic level to the low logic level, the first switches SW1 are turned off and inactivate the charge sharing operation and the second switches SW2 are turned on and allow the output of the data voltage.

When the charge share control signal CSC of the low logic level is generated, the third switch SW3 is turned off and blocks the source output enable SOE from being applied to the charge share circuit 227. In this instance, the second switches SW2, which have been turned on so as to reset the data driving circuit during a blank period between a previous frame period and a current frame period, remain in the turned-on state. Further, because the first switches SW1 cannot be turned on, the charge sharing operation is inactivated.

Figure 10:
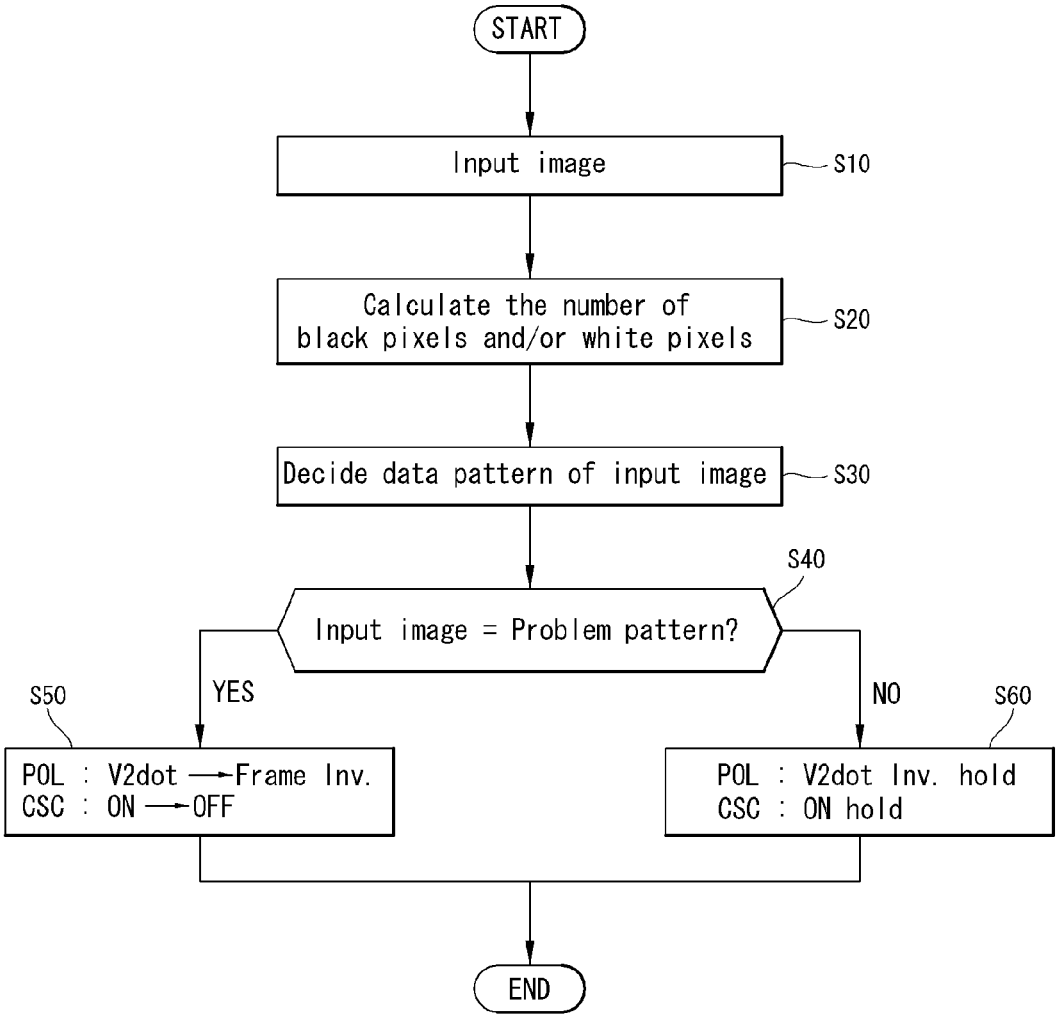
FIG. 10 illustrates a method for driving a liquid crystal display according to an example embodiment of the invention.

FIG. 10 illustrates a method for driving the liquid crystal display according to the example embodiment of the invention.

As shown in FIG. 10, a method for driving the liquid crystal display according to the example embodiment of the invention calculates the number of black pixels, white pixels, or both included in an input image and decides whether or not the input image is the problem pattern based on the calculation result in steps S10 to S30.

When the problem pattern appears as a full black pattern, the method counts the number of black pixels included in the input image. When a count value of the black pixels is greater than a first reference value, that is previously set, the method decides the input image as the problem pattern. When the count value of the black pixels is equal to or less than the first reference value, the method decides the input image as the normal pattern. Further, when the problem pattern appears as a full white pattern, the method counts the number of white pixels included in the input image. When a count value of the white pixels is greater than a second reference value, that is previously set, the method decides the input image as the problem pattern. When the count value of the white pixels is equal to or less than the second reference value, the method decides the input image as the normal pattern. Further, when the problem pattern appears as an L80 pattern, the method counts the number of white pixels and the number of black pixels. When a count value of the white pixels is within a first reference range, that is previously set, and at the same time a count value of the black pixels is within a second reference range, that is previously set, the method decides the input image as the problem pattern. When the count value of the white pixels is greater than the first reference range, and at the same time the count value of the black pixels is greater than the second reference range, the method decides the input image as the normal pattern.

When the input data pattern is the problem pattern, the method increases a logic level inversion period of the polarity control signal POL from k horizontal period (where k is 2), that has been previously set to a default value, to one frame period, and at the same time, inverts the charge share control signal CSC from a low logic level L, that has been previously set to a default value, to a high logic level, thereby inactivating the charge sharing function of the data driving circuit in step S50. Hence, because the data voltage swings between the positive maximum power voltage Vdd and the negative maximum power voltage Vss in units of one frame period in response to the input of the problem pattern, the number of transition operations of the data voltage in the embodiment of the invention is greatly reduced as compared to the related art, in which the data voltage swings on the basis of line. As a result, the power consumption of the data driving circuit is greatly reduced.

When the input data pattern is the normal pattern, the method holds the logic level inversion period of the polarity control signal POL in the k horizontal period, and at the same time, holds the logic level of the charge share control signal CSC at the low logic level, thereby activating the charge sharing function of the data driving circuit in step S60. As a result, because an initial output level of the data driving circuit changes to a middle level in response to the input of the normal pattern, the power consumption of the data driving circuit is reduced.

As described above, the liquid crystal display and the method for driving the same according to the example embodiment of the invention selectively activate the charge sharing function of the data driving circuit based on the input data pattern and vary the polarity inversion period of the data voltage, thereby reducing the power consumption of the data driving circuit irrespective of the input data pattern.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A liquid crystal display comprising:

a liquid crystal display panel including a plurality of data lines, a plurality of gate lines crossing the plurality of data lines, and a plurality of liquid crystal cells arranged at crossings of the data lines and the gate lines in a matrix form;

a data driving circuit configured to supply a data voltage to the data lines; and a power consumption reduction circuit configured to calculate the number of black pixels, white pixels, or both included in an input image, decide whether or not the input image is a problem pattern increasing power consumption of the data driving circuit based on the calculation result, selectively activate a charge sharing function, which shorts between adjacent output channels of the data driving circuit during a predetermined period, and differently control a polarity inversion period of the data voltage based on the decision result, wherein when the input image is the problem pattern, the power consumption reduction circuit increases a logic level inversion period of a polarity control signal from k horizontal period (where k is a positive integer), that has been previously set to a default value, to one frame period, and at the same time, inverts a charge share control signal from a high logic level, that has been previously set to a default value, to a low logic level, in order to inactivate the charge sharing function, wherein when the input image is a normal pattern other than the problem pattern, the power consumption reduction circuit holds the logic level inversion period of the polarity control signal in the k horizontal period, and at the same time, holds the logic level of the charge share control signal at the high logic level, in order to activate the charge sharing function.

2. The liquid crystal display of claim 1, wherein the power consumption reduction circuit includes:

a frame counter configured to count the number of vertical sync signals and generate a first count signal;

a line counter configured to count the number of horizontal sync signals and generate a second count signal;

a problem pattern deciding unit configured to calculate the number of black pixels, white pixels, or both included in the input image, decide whether or not the input image is the problem pattern based on the calculation result, generate the charge share control signal of the low logic level when the input image is the problem pattern, and generate the charge share control signal of the high logic level when the input image is the normal pattern;

an AND gate configured to perform AND operation on the second count signal received from the line counter and the charge share control signal received from the problem pattern deciding unit and generate a third count signal; and a polarity controller configured to control the logic level inversion period of the polarity control signal based on the first count signal received from the frame counter and the third count signal received from the AND gate.

3. The liquid crystal display of claim 1, wherein the data driving circuit includes:

a plurality of first switches, each of which is connected between the two adjacent output channels so as to perform the charge sharing function;

a plurality of second switches, each of which is connected between an output buffer and the output channel;

a third switch configured to selectively apply a source output enable to the first switches in response to the charge share control signal; and a plurality of inverters configured to invert the source output enable and apply the inverted source output enable to the second switches.

4. The liquid crystal display of claim 1, wherein the liquid crystal display panel represents a gray level by a voltage level difference between the data voltage and a common voltage, wherein when the liquid crystal display panel operates in a normally white mode, in which a low gray level is represented as the voltage level difference increases, the problem pattern includes a full black pattern.

5. The liquid crystal display of claim 1, wherein the liquid crystal display panel represents a gray level by a voltage level difference between the data voltage and a common voltage, wherein when the liquid crystal display panel operates in a normally black mode, in which a high gray level is represented as the voltage level difference increases, the problem pattern includes at least one of a full white pattern and an L80 pattern, wherein the L80 pattern indicates a data pattern in which a percentage of a white area based on an effective display area is about 64% and a percentage of a black area based on the effective display area is about 36%.

6. A method for driving a liquid crystal display including a liquid crystal display panel including a plurality of data lines, a plurality of gate lines crossing the plurality of data lines, and a plurality of liquid crystal cells arranged at crossings of the data lines and the gate lines in a matrix form and a data driving circuit supplying a data voltage to the data lines, the method comprising:

(A) calculating the number of black pixels, white pixels, or both included in an input image;

(B) deciding whether or not the input image is a problem pattern increasing power consumption of the data driving circuit based on the calculation result; and (C) selectively activating a charge sharing function, which shorts between adjacent output channels of the data driving circuit during a predetermined period, and differently controlling a polarity inversion period of the data voltage based on the decision result wherein (C) includes:

when the input image is the problem pattern, increasing a logic level inversion period of a polarity control signal from k horizontal period (where k is a positive integer), that has been previously set to a default value, to one frame period, and at the same time inverting a charge share control signal from a high logic level, that has been previously set to a default value, to a low logic level, to inactivating the charge sharing function, and when the input image is a normal pattern other than the problem pattern, holding the logic level inversion period of the polarity control signal in the k horizontal period, and at the same time holding the logic level of the charge share control signal at the high logic level, to activating the charge sharing function.

7. The method of claim 6, wherein (C) includes:

counting the number of vertical sync signals and generating a first count signal;

counting the number of horizontal sync signals and generating a second count signal;

performing AND operation on the second count signal and the charge share control signal and generating a third count signal; and controlling the logic level inversion period of the polarity control signal based on the first count signal and the third count signal.

* * * * *